United States Patent [19]

Helfgen et al.

[11] 4,113,811

[45] Sep. 12, 1978

[54] PROCESS FOR THE PRODUCTION OF FLEXIBLE EXPLOSIVE FORMED CHARGES

[75] Inventors: Werner Helfgen, Troisdorf; Gerhard Lindner, Leverkusen; Paul Lingens, Odenthal-Glöbusch; Helmut Kaufmann, Troisdorf, all of Germany

[73] Assignee: Dynamit Nobel Aktiengesellschaft, Germany

[21] Appl. No.: 702,593

[22] Filed: Jul. 6, 1976

Related U.S. Application Data

[63] Continuation-in-part of Ser. No. 702,020, Jul. 2, 1976, abandoned.

[30] Foreign Application Priority Data

Jul. 2, 1975 [DE] Fed. Rep. of Germany ..... 2529432

[51] Int. Cl.[2] ..... C06B 45/10

[52] U.S. Cl. ..... 264/3 R; 149/19.9; 149/19.91; 149/19.92; 149/92

[58] Field of Search ..... 149/19.9, 19.91, 19.92, 149/92; 264/3 R

[56] References Cited

U.S. PATENT DOCUMENTS

| | | | |
|---|---|---|---|
| 3,321,341 | 5/1967 | Ottoson | 149/19.91 |
| 3,338,764 | 8/1967 | Evans | 149/19.91 X |
| 3,449,179 | 6/1969 | Minekawa et al. | 149/20 X |
| 3,501,357 | 3/1970 | Suzuki et al. | 149/19.9 X |
| 3,839,106 | 10/1974 | De Prisque et al. | 149/19.9 |
| 3,888,707 | 6/1975 | Rothstein | 149/19.9 |
| 3,914,141 | 10/1975 | Sayles | 149/92 X |

*Primary Examiner*—Edward A. Miller

*Attorney, Agent, or Firm*—Craig & Antonelli

[57] ABSTRACT

A process for producing flexible formed explosive charges includes the steps of admixing at least one elastomer which exhibits an elongation of at least 800% and a tear strength of between 50 and 350 kp./cm$^2$, at least one high-brisance explosive component and at least one plasticizer that has a melting point of less than −20° C. and that does not substantially evaporate up to a temperature of 90° C. and thereafter forming the resulting admixture into a shaped or formed explosive charge. The high-brisance explosive component has a detonating velocity of at least 6000 m/sec.

9 Claims, No Drawings

PROCESS FOR THE PRODUCTION OF FLEXIBLE EXPLOSIVE FORMED CHARGES

CROSS-REFERENCE TO RELATED APPLICATION

This application is a Continuation-in-Part of co-pending application Ser. No. 702,020 filed on July 2, 1976, and now abandoned.

The present invention relates to a process for the production of flexible preformed explosive charges wherein a crystalline, highly explosive component is mixed with thermoplastic synthetic resins and plasticizers, and the thus-obtained mixture is then subjected to a forming step. The manufacturing process for the formed explosive charges is carried out so that no water and/or volatile solvents are added. The thus-produced formed explosive charges possess extraordinarily high values for elongation and plastic deformability within broad temperature ranges, exceeding those of conventional flexible formed explosive charges. Also, this invention relates to the explosive compositions used in the aforementioned process and the product obtained from the process.

Elastic formed explosive charges made of high-brisance explosives and synthetic resins have been known. Thus, according to German Pat. No. 1,172,589, for example, flexible explosive compositions are manufactured consisting of 40–90% of high explosives containing an inert carrier substance obtained by vulcanization from latex. The carrier substance can also consist of depolymerized rubber in place of latex.

A disadvantage in the forming of these compositions is that the solvent contained in the composition must be removed after the forming step, which takes place by casting or extrusion. The removal of these solvents by drying at 70°–80° C. entails many dangerous aspects and leads to explosive compositions having undesirable shrink holes and pores if the solvents are removed too quickly. The actual, desired density is only attained by an additional secondary compacting step, for example by the compression of previously rolled sheets.

Also the explosive mixtures made of high-brisance explosives and elastomers as described in German Pat. No. 1,110,065, which are self-supporting and can be shaped into thin sheets and other configurations, exhibit the same disadvantages. These explosive mixtures must likewise be produced with the use of water and optionally solvents, which later on must be removed again under additional technical expenditure and incurring the above-mentioned dangerous risks.

The formed explosive charges according to DOS (German Unexamined Laid-Open Application) No. 2,313,886 are prepared without the use of water or organic solvents, so that a portion of the above-recited disadvantages is eliminated in the manufacture thereof. However, the production of these formed charges has the disadvantage, in turn, that it takes place in two stages: in the first stage, a prepolymer is mixed with the high explosives; this mixture is then combined with a curing agent and cast into the desired shaped charges. The cured synthetic resin is designated as not being thermoplastic; it is cross-linked. The thus-obtained explosive formed charges accordingly possess a tensile strength and flexibility which, with about 3.3 kp./cm$^2$ and maximally 155%, can be considered adequate. Besides, these formed charges exhibit a relatively high impact sensitivity. Another disadvantage is that the formed charges can only be produced in a batch-wise operation.

The problem to be solved thus consisted in discovering flexible formed explosive charges which can be manufactured without the use of water or organic solvents in a continuous as well as discontinuous manner, optimally in one operating step, which have an elongation at normal temperature that is at least 200%, which are extensively fracture-resistant in large temperature ranges, and which have a dynamic transition temperature (i.e. glass point) of below −20° C. Furthermore, the explosive formed charges are to have detonating velocities of above 6000 m./sec. and are to be maximally insensitive to shock and friction. These formed explosive charges are to be ignitable by primer caps as well as by fuzes.

This problem has now been solved by providing a process for the production of flexible formed explosive charges characterized by using conventional mixing procedures to mix prefabricated elastomers having an elongation of at least 800% and a tear strength of between 50 and 350 kp./cm$^2$, as well as plasticizers having a melting point of below −20° C. and which do not evaporate practically up to a temperature of 100° C., together with a crystalline, high-brisance explosive component, in the absence of water and/or readily volatile solvents; and subsequently subjecting the thus-obtained mixture to a forming process.

In such a manufacturing process, the disadvantages of the conventional production methods do not occur, and formed explosive charges are obtained which retain their imparted shape after the forming step, which are plastically deformable to a high degree within broad temperature limits without great recoil, and which do not show any crack formation until −32° C. These charges possess an elongation of higher than 200% at rupture load during the tensile-strength test at normal temperature and a drawing speed of 50 mm./min. Furthermore, the thus-obtained formed charges are not tacky, so that they can be packaged immediately after having been cut to the desired sizes, without the individual charges sticking to one another. Another distinguishing feature of these charges is their low-temperature stability.

The surfaces of the formed articles are generally free of pores, dense, and have a smooth structure.

The detonating velocities of the flexible explosive formed charges are above 6000 m./sec. The high-brisance explosive component consists either exclusively of crystalline, high-brisance explosives having a detonating velocity of above 8000 m./sec., such as, for example, pentaerythritol tetranitrate, cyclotrimethylenetrinitramine (hexogen), cyclotetramethylenetetranitramine (octogen), or trinitrophenylmethylnitramine (tetryl). However, alternatively, the high-brisance explosive component can consist of a mixture of these crystalline high-brisance explosives with other crystalline explosives or alkali nitrates or ammonium nitrate. Also combustible components, such as, for example, aluminum, magnesium or light metal alloys, containing these metals as the alloy component, can be contained in the mixtures. The composition of these explosive mixtures, however, should be chosen so that the detonating velocity of the resultant formed article is above 6000 m./sec. In general, the proportion of the crystalline high-brisance explosives such as pentaerythritoltetranitrate is from 20 to 99 of the explosive component.

The proportion of the high-brisance explosive component in the formed explosive charges range between 60% and 85%, preferably between 70% and 80% by weight.

The elastomer to be utilized is to have an elongation of more than 800% and a tear resistance of between 50 and 350 kp./cm$^2$. These values are measured in accordance with DIN (German Industrial Standard) 53 455.

Furthermore, the elastomer is to have a dynamic glass transition temperature of −20° C.

Suitable elastomers for the purposes of this invention are copolymers of ethylene with about 45% by weight vinyl acetate, produced according to the intermediate pressure method. However, also suitable are copolymers of 20 to 80% by weight of acrylonitrile, 20 to 80% by weight of butadiene and 20 to 50% by weight of styrene, or copolymers of acrylic esters, e.g. ethyl ester of acrylic acid or methyl ester of methacrylic acid with 10 to 50% by weight of ethylene, propylene, or vinyl chloride, insofar as they exhibit the aforementioned properties. Generally, these elastomers have a molecular weight of from 50,000 to 500,000.

The elastomer is utilized together with a plastizer, wherein the plasticizer must be compatible with the elastomer as well as with the explosive component. Important conditions for the usability of a plasticizer are its melting point, which is to be below −20° C., and the characteristic of practically not evaporating at all when being heated to 90° C. The latter means that the plasticizer, when heated to 90° C., has within 100 hours a weight loss below 5% by weight.

Plasticizer compounds having these characteristics are, for example, the dialkyl esters of phthalic acid and adipic acid, wherein each ester component can have 4–12 carbon atoms, such as, for example, dioctyl phthalate, diisobutyl phthalate, dimethyl glycol phthalate, or dioctyl adipate.

The weight ratio of plasticizer to elastomer in the charge can be varied between 1:10 and 10:1, The proportion of the elastomers and plasticizers in the finished explosive formed charge is between 15 and 40% by weight, preferably between 20 and 30% by weight.

The explosive component, the elastomers, and the plasticizers are mixed together in a conventional manner. However, an essential factor is that the mixing step takes place without the addition of water or readily volatile solvents.

Therefore, it is unnecessary during or subsequently to the mixing or forming step to again remove any solvents by suitable physical measures, e.g. vacuum drying or storage at an elevated temperature. The term "readily voltatile solvents" is understood to mean, in this connection, those solvents which have heretofore been employed in conventional mixing processes of explosives with synthetic resins and which have boiling points of below 100° C. Exemplary of these solvents are acetcene, ethyl acetate, and methylene chloride.

Optionally, the mixing step takes place at an elevated temperature, wherein temperatures of above 85° C. are not to be exceeded, if at all possible. As the discontinuous mixing devices, masticators of conventional constructions and modes of operation are utilized, equipped, for example, with planetary agitator arms or Z-shaped or $\sigma$-like vanes. If the mixing step is to be conducted at an elevated temperature, the masticators are additionally provided with a double jacket which can be heated by means of hot water to about 90° C.

The composition obtained after the mixing step can be processed without adding water or solvents in the warm as well as in the cold state by means of conventional processing apparatus, such as rolls, hydraulic presses, or extruders. This forming procedure can be conducted in a temperature range of between 10° and 70° C., preferably between 20° and 50° C., thus producing endless sheets, strips, panels, solid skeins, and tubular articles. In this connection, it is quite possible to manufacture thin sheets or panels having a thickness of as little as 1 mm. which still detonate fully after ignition.

The explosive compositions for the formed charges according to this invention can also be produced continuously in conventional apparatus. It is likewise possible, by combining two machine units, to conduct the mixing and shaping immediately in a single installation.

The thus-produced molded articles can be utilized directly after having been manufactured, without providing any casing or insertion. However, it is also possible to produce thin sheets, strips, or panels provided on one or both sides with bilaterally adhesive films which, in turn, have a readily detachable protective film.

After removing this protective film on one side of the explosive formed charges, the latter can be attached in a self-adhesive fashion to vertical walls of rock, concrete, aluminum, steel, wood, or glass and then ignited; in this way, it is possible, for example, to blast exact openings or holes of a previously determined size.

It is furthermore possible to encase an extruded explosive formed charge immediately after exiting from the die with a film, for example on the basis of polyvinyl chloride, polyethylene, or other synthetic resin, with the use of a second plastic extruder.

Instead of being encased by films, the surface of the formed charges can also be enveloped by braided or spun yarn or fabric, wherein suitable threads or fabrics are all commercially available products, such as linen, wool, cotton, silk, glass fibers, metallic threads, or threads on the basis of polyesters, polyamides, etc.

Moreover, these two possibilities can be combined, i.e. first the explosive charge is encased by a film and then enveloped by yarn or fabric — or vice versa. The factor governing the particular method utilized is merely the purpose for which the charge will be used.

If formed explosive charges are to be prepared which have a higher tensile strength and/or tear streangth, it is furthermore possible to incorporate into these formed charges reinforcing means, again in the form of yarns, fibers, spun fabrics, or threads, or hoses made of the aforementioned materials. The incorporation of such reinforcing agents, however, perforce reduces the ductility of the formed articles. The incorporation of these agents as supporting elements into the core of the formed articles takes place conventionally on a rolling mill for panels, strips, and sheets, and on the extruder for extruded profiles, such as rods, hoses, etc., by reeling off the reinforcing means synchronously with the feeding rate of the formed articles and centrally guiding the reinforcing means by appropriate guide plates, guide rollers, hollow needles, etc. Generally, the amount of reinforcing agent constitutes from 1 to 20% of the finished formed charge.

A surprising aspect is constituted by the low processing temperatures of 10°–70° C., preferably 20°–50° C. during the shaping of the formed charges of this invention. These temperatures are a special part of this invention and could not be foreseen. While, as experience has shown, synthetic resins are usually extruded, for example, at temperatures lying in part above the melting point (up to 150° C.) of the elastomer, it is possible herein to operate with the aforementioned, extraordinarily low temperatures. This is of a particularly great advantage for reasons of safety, since thereby part of the possible dangers is excluded right from the beginning.

The elimination of any kind of solvent or solubilizer furthermore represents an advantage over other methods, along the lines of work and health protection, since no technical measures whatever are required, such as the exhausting of solvent-air mixtures by ventilators, or the feeding of fresh air, and since the personnel taking part in the manufacture of the explosive composition and the formed charges need not wear any additional protective outfits, such as masks and so on.

The invention will be further understood from the following examples:

EXAMPLE 1

| Composition of batch mixture: | | Wt. % |
|---|---|---|
| Explosive: | Pentaerythritol tetranitrate, granular size: 100% < 0.15 mm. | 73% |
| Elastomer: | Copolymer of ethylene with 45% vinyl acetate (commercially available under the name of "Levapren" U 50, Bayer AG, Leverkusen) | 18% |
| Plasticizer: | Dimethyl glycol phthalate | 9% |

The components of the batch are mixed, adapted to a charge of 3 kg., in a suitable masticator while feeding heat by means of water having a temperature of about 85° C. in the double jacket of the mixer. The mixture is mixed for about 30 minutes until a dough-like, viscous, non-tacky homogeneous mass has been produced. Subsequently, a portion of the explosive composition is rolled between rolls into different panels having a thickness of between 1.3 mm. and 9 mm., and then cut into strips.

Another portion was processed in accordance with the extrusion method. For this purpose, a special tool, i.e. a die was made, by means of which an endless tube was manufactured having an outer diameter of 17 mm. and a core diameter of 6 mm. The temperatures during the extrusion step were, in the processing section of the twin-screw extruder, between 25° and 35° C. and, in the die, between 35° and 45° C., wherein pressures were measured of between 150 and 200 kp./cm$^2$. The ejection speed of the formed explosive charges was 20 cm./min. Additional technical aids as frequently necessary in extrusion processes, such as, for example, supporting air for hollow profiles or water baths for cooling the profiles to prevent deformation thereof, were unnecessary.

Another portion of the explosive composition was processed, for the purpose of subsequent use in an extruder, by means of a special tool having a perforated plate into granules of a cylindrical configuration, having a diameter of 3.5 mm. and a length of 3.5 mm. This was accomplished without any heat supply to machine and tool, i.e. at room temperature of about 20° C. The thus-obtained granulated material was pourable and could be extruded later on flawlessly to formed articles.

The following physical data were determined in connection with the thus-obtained formed explosive charges:

1. Detonating Velocity 1.1 Measured on rolled strips, cut to a width of 50 mm. and a thickness of 2.0 mm.: V = 7000 m./sec.

1.2 Measured on a tube having an outer diameter of 17 mm. and an inner diameter of 6 mm.: V = 7800 m./sec.

2. Density: 1.40 g./cm$^3$

3. Tear Strength 3.1 Measured on a test specimen according to DIN 53 455 having a cross section of 1 cm$^2$ $\sigma_R$ = 2.5 kg.

3.2 Measured on a tube having the dimensions according to 1.2:

$\sigma_R$ (at −40° C.) = 19.4 kp./cm$^2$
$\sigma_R$ (at +20° C.) = 2.7 kp./cm$^2$
$\sigma_R$ (at +50° C.) = 0.21 kp./cm$^2$ 4. Ultimate Elongation 4.1 Measured on DIN specimens according to 3.1 = 120%.

4.2 Measured on a tube having the dimensions according to 1.2:

$_\epsilon$(at −40° C.) = 177%
$_\epsilon$(at +20° C.) = 289%
$_\epsilon$(at +50° C.) = 125%

5. Flexural Strength at $t$ = minus 32° C.

5.1 Measured on rolled strips according to 1.1:

| Thickness | Flexing Time | | Bending Angle | Result |
|---|---|---|---|---|
| 1.3 | 0.5 | seconds | 180° | No crack formation |
| | 12.0 | seconds | 180° | |
| 3.0 | 0.5 | seconds | 180° | " |
| | 14.0 | seconds | 180° | " |
| 5.0 | 0.5 | seconds | 180° | " |
| | 12.0 | seconds | 180° | " |

5.2 Measured on a tube having the dimensions according to 1.2:

| Flexing Time | Bending Radius | Bending Angle | Result |
|---|---|---|---|
| 12.0 sec. | 10 mm. | 180° | No crack formation |

6. Falling-Hammer Resistance

Falling weight: 5 kg. Falling height: 40 cm.

Explosion.

With a low falling weight or a low falling height, no reaction occured.

7. Friction Sensitivity

In the friction apparatus according to BAM at 36 kp.: slight crackling.

8. Ignition Test

With an explosive tube according to 1.2, used as a propagation charge, length 50 mm. Flawless detonation with a blasting cap No. 8.

EXAMPLE 2

| Composition of Mixture: | | Wt. % |
|---|---|---|
| Explosive: | Pentaerythritol tetranitrate, granular size: 100% < 0.5 mm. | 75% |
| Elastomer: | See Example 1 | 17% |
| Plasticizer: | Dimethyl glycol phthalate | 8% |

The mixing and further processing steps are carried out analogously to Example 1.

Physical data:

1. Detonating Velocity

V = 7400 m./sec.

Density, tear strength, elongation showed the same values as in Example 1.

The falling-hammer resistance yields an explosion at a falling weight of 1 kg. and a falling height of 40 cm.; with a low falling weight or a low falling height, no reaction occurred. In the friction apparatus according to BAM, slight crackling occurred at 24 kp.

The ignition tests yielded no change as compared to Example 1.

EXAMPLE 3

| Composition of Mixture: | | Wt. % |
|---|---|---|
| Explosive: | Pentaerythritol tetranitrate, granular size: 100% < 0.15 mm. | 35% |
| | Ammonium nitrate, extremely fine | 41% |
| Elastomer: | As described in Example 1 | 16% |
| Plasticizer: | Dimethyl glycol phthalate | 8% |

The composition is mixed analogously to Example 1; further processing was accomplished by extrusion to solid skeins or rods of a diameter of 15 mm. to about 30 mm.

Ignition Test to Determine Critical Diameter

Solid rods having a diameter of 15 mm. and thereabove could be flawlessly detonated with a blasting cap No. 8.

What is claimed is:

1. A process for the production of flexible explosive formed charges having a detonation velocity above 6000 m/sec which comprises mixing, without the addition of water, a volatile solvent, or mixtures thereof, a thermoplastic synthetic resin comprising at least one elastomer which exhibits an elongation of at least 800% and a tear strength of between 50 and 350 kp./cm$^2$ and which comprises a copolymer of ethylene with about 45% by weight of vinyl acetate, a copolymer of acrylonitrile, butadiene and styrene, or a copolymer of an acrylic ester with ethylene, propylene, or vinyl chloride, with a crystalline, high-brisance explosive component having a detonation velocity above 8000 m/sec and at least one plasticizer having a melting point of less than −20° C. and that practically does not evaporate up to a temperature of 90° C., and thereafter forming the mixture into an explosive charge, the high-brisance explosive component being utilized in amounts of 60–85% by weight, the elastomer being employed in amounts of 15–40% by weight, and the ratio of elastomer to plasticizer being between 1:10 and 10:1.

2. The process for the production of flexible explosive formed charges according to claim 1, wherein a mixture is used, as the crystalline, high-brisance explosive component, which contains in addition to a high-brisance explosive an oxygen-yielding component and/or a combustible component.

3. The process for the production of flexible formed explosive charges according to claim 1, which further comprises encasing the outer surface of the formed explosive charge by a film, yarn, or fabric.

4. The process for the production of flexible formed explosive charges according to claim 1, which further comprises incorporating reinforcing means in the form of a yarn, fiber, or thread or hose into a core portion of the charge.

5. A flexible formed explosive charge produced according to the process of claim 1.

6. The process for the production of flexible explosive formed charges according to claim 1, wherein the high-brisance explosive component comprises a mixture of said crystalline high-brisance explosive and another crystalling explosive or alkali nitrate or ammonium nitrate, said mixture exhibiting a detonating velocity above 6000 m/sec.

7. The process for the production of flexible explosive formed charges according to claim 6, wherein the plasticizer comprises a dialkyl ester of phthalic acid or adipic acid wherein each alkyl group contains from 4 to 12 carbon atoms.

8. The process for the production of flexible explosive formed charges according to claim 6, wherein the amount of the high-brisance explosive is from 20 to 99% of the explosive component.

9. The process for the production of flexible explosive formed charges according to claim 1, wherein the plasticizer employed is a plasticizer that when heated to 90° C. has within 100 hours a weight loss below 5% by weight.

* * * * *